US008226816B2

(12) United States Patent
Kennel et al.

(10) Patent No.: US 8,226,816 B2
(45) Date of Patent: Jul. 24, 2012

(54) METHOD OF PRODUCING SYNTHETIC PITCH

(75) Inventors: Elliot B. Kennel, Morgantown, WV (US); Peter G. Stansberry, North Olmsted, OH (US); Alfred H. Stiller, Morgantown, WV (US); John W. Zondlo, Albright, WV (US)

(73) Assignee: West Virginia University, Morgantown, WV (US)

( * ) Notice: Subject to any disclaimer, the term of this patent is extended or adjusted under 35 U.S.C. 154(b) by 514 days.

(21) Appl. No.: 11/805,737

(22) Filed: May 24, 2007

(65) Prior Publication Data

US 2008/0017549 A1 Jan. 24, 2008

Related U.S. Application Data

(60) Provisional application No. 60/808,084, filed on May 24, 2006.

(51) Int. Cl.
*C10C 1/18* (2006.01)
*C10G 73/23* (2006.01)

(52) U.S. Cl. ..... 208/39; 208/22

(58) Field of Classification Search ..... 208/431, 208/434, 425, 4, 22, 39, 40–45, 80–95, 39.4
See application file for complete search history.

(56) References Cited

U.S. PATENT DOCUMENTS 3,505,203 A * 4/1970 Nelson ..... 208/416
3,954,544 A 5/1976 Hooker
4,081,361 A 3/1978 Hildebrand et al.
4,179,352 A 12/1979 Effron
4,211,576 A * 7/1980 Yan ..... 106/278
4,259,171 A * 3/1981 Stadelhofer et al. ..... 208/45
4,272,356 A 6/1981 Stiller et al.
4,303,496 A 12/1981 Rudnick
4,334,977 A 6/1982 Derbyshire et al.
4,369,171 A * 1/1983 Grindstaff et al. ..... 423/461
4,394,248 A 7/1983 Gatsis
4,465,495 A 8/1984 Scheffee
4,475,924 A 10/1984 Meyer
4,551,224 A 11/1985 Kuhlmann
4,610,776 A 9/1986 Urban et al.
4,617,105 A 10/1986 Miller
4,671,801 A 6/1987 Burgess et al.
4,762,527 A 8/1988 Beshore et al.
4,959,139 A * 9/1990 Blakeburn et al. ..... 208/39

(Continued)

FOREIGN PATENT DOCUMENTS

JP 56-072079 6/1981

(Continued)

OTHER PUBLICATIONS

"Modification of Coal Tar Pitch by Air Blowing I Variaion of Pitch Composiiton and Properties" by Fernandez, J. Figuerias, A., Granda, M. Bernejo, J. and Menendez, R. Carbon vol. 33 No. 3 pp. 295-307 (1995).*

(Continued)

*Primary Examiner* — Cephia D Toomer
*Assistant Examiner* — Pamela H Weiss
(74) *Attorney, Agent, or Firm* — The Webb Law Firm

(57) ABSTRACT

Embodiments of a method are described for modifying pitches, oils, tars, and binders by using these materials as solvents to extract organic chemicals from coal.

4 Claims, 3 Drawing Sheets

U.S. PATENT DOCUMENTS

| | | | | |
|---|---|---|---|---|
| 4,997,548 | A | 3/1991 | Rantell et al. | |
| 5,182,011 | A | 1/1993 | Tsuchitani et al. | |
| 5,208,003 | A | 5/1993 | Simandl et al. | |
| 5,262,043 | A * | 11/1993 | Boenigk et al. | 208/41 |
| 5,300,272 | A | 4/1994 | Simandl et al. | |
| 5,746,906 | A * | 5/1998 | McHenry et al. | 208/22 |
| 5,868,974 | A | 2/1999 | Kearns | |
| 5,888,469 | A | 3/1999 | Stiller et al. | |
| 5,955,375 | A | 9/1999 | Zondlo et al. | |
| 5,961,814 | A | 10/1999 | Kearns | |
| 6,129,773 | A | 10/2000 | Killick et al. | |
| 6,241,957 | B1 | 6/2001 | Stiller et al. | |
| 6,287,375 | B1 | 9/2001 | Klett | |
| 6,344,159 | B1 | 2/2002 | Klett | |
| 6,387,343 | B1 | 5/2002 | Klett | |
| 6,399,149 | B1 | 6/2002 | Klett et al. | |
| 6,506,354 | B1 | 1/2003 | Stiller et al. | |
| 6,544,491 | B1 | 4/2003 | Stiller et al. | |
| 6,576,168 | B2 | 6/2003 | Hardcastle et al. | |
| 6,656,443 | B2 | 12/2003 | Klett | |
| 6,663,842 | B2 | 12/2003 | Klett | |
| 6,689,336 | B2 | 2/2004 | Kanno et al. | |
| 6,712,866 | B2 | 3/2004 | Paul | |
| 6,797,251 | B1 | 9/2004 | Bennett et al. | |
| 6,833,012 | B2 | 12/2004 | Rogers | |
| 6,860,910 | B2 | 3/2005 | Rogers et al. | |
| 6,869,455 | B2 | 3/2005 | Rogers et al. | |
| 7,014,668 | B2 | 3/2006 | Golubkov et al. | |
| 7,070,755 | B2 | 7/2006 | Klett et al. | |
| 2005/0097814 | A1 | 5/2005 | Sugita et al. | |
| 2008/0072476 | A1 | 3/2008 | Kennel et al. | |
| 2009/0250381 | A1 | 10/2009 | Fan et al. | |
| 2011/0230688 | A1 | 9/2011 | Chardon et al. | |

FOREIGN PATENT DOCUMENTS

| | | |
|---|---|---|
| JP | 05-230469 | 9/1993 |

OTHER PUBLICATIONS

Production of Carbon Products Using Coal Extraction Process DE-FC26-02NT41596 Final Report Sep. 11, 2002-Aug. 31, 2004, Dadyburjor (referred to as Dadyburjor) Published Dec. 12, 2005 http://www.osti.gov/energycitations/product.biblio.jsp?osti_id=862313.*

Dadyburjor et al., "Production of Carbon Products Using a Coal Extraction Process," NETL Contract No. DE-FC26-02NT41596, National Energy Technology Laboratories Final Report Sep. 11, 2002-Aug. 31, 2004, Published Dec. 12, 2005, pp. 1-233, U.S. Department of Energy, Pittsburgh, Pennsylvania.

Fernández et al., "Modification of Coal-Tar Pitch by Air-Blowing I. Variation of Pitch Composition and Properties," Carbon, 1995, pp. 295-307, vol. 33, No. 3, Elsevier Science Ltd., Great Britain.

Taylor et al., "Future Synthetic Fuels: A Scientific and Technical Applications Forecast-1975," Sep. 1975, US Army Contract DAA05-73-C-0559.

"Increased Automobile Fuel Efficiency and Synthetic Fuels: Alternatives for Reducing Oil Imports," NTIS Order No. PB83-126094, 1982.

Stansberry et al., "Development of binder pitches from coal extract and coal-tar pitch blends," 2001, pp. 581-585, Light Metals.

"The Carbon Products Industry Vision for the Future", Sep. 1998, pp. i-vii; 1-27, Carbon Products Consortium.

Wombles, Robert A., "Experience with Petroleum Enhanced Coal Tar Pitch", 2000, pp. 1-11, http://www.koppers.com/htm/PandS_RanD_WhiteP.html.

Elliott, J.D., "Fine-Tune Your Delayed Coker: Obstacles and Objectives", Sep. 2004 issue, pp. 83-90, www.HydrocarbonProcessing.com.

"Tar and Pitch", pp. 1-31, Kirk-Othmer Encyclopedia of Chemical Technology.

* cited by examiner

METHOD OF PRODUCING SYNTHETIC PITCH

CROSS REFERENCE TO RELATED APPLICATIONS

This application claims the benefit of U.S. Provisional Patent Application No. 60/808,084, filed May 24, 2006, the entire disclosure of which is considered as part of the disclosure of the present application and is hereby incorporated by reference herein.

STATEMENT REGARDING FEDERALLY SPONSORED RESEARCH OR DEVELOPMENT

This invention was made with government support under DOE Grant Nos. DE-FC26-02NT41596 and DE-FC26-06NT42761 awarded by the United States Department of Energy. The government has certain rights in the invention.

TECHNICAL FIELD

The present invention relates to synthetic pitch, particularly methods for producing synthetic pitch using solvent extraction of coal.

BACKGROUND

Pitches are hydrocarbon liquids that are solid at ambient temperature, but that melt upon heating. Upon further heating, volatile gases are evolved from the pitch, resulting in a solid residue that mainly comprises carbon. This solid residue is referred to as coke. In general, pitches may comprise a wide range of chemicals with a distribution of molecular weights, rather than a single component.

Conventional pitches may be obtained as byproducts from petroleum refining or metallurgical grade coke production ovens. In the latter case, volatile components evolved during the coking process are collected in the form of a tar. This tar may then be further refined by use of distillation to remove low boiling point materials, resulting in a pitch residue. Both petroleum pitches and coal tar pitches can be used for a variety of applications including use as binder pitch, anode pitch (i.e., an anode coke precursor pitch), graphite pitch, impregnation pitch, hard pitch, soft pitch, and others.

Raw coal generally is not considered to be a pitch because it devolatilizes before it can soften or melt. However, a synthetic pitch, also referred to as a "Synpitch," can be created by extracting coal in a hydrocarbon solvent at an elevated temperature such that a molten slurry is formed. Typically, undissolved solids are removed by filtration or centrifugation and the solvent is removed via distillation. The softening point, coke yield, and aromatic content of the resultant pitch may be modified by distillation and/or air blowing.

A related process is direct liquefaction, in which coal is converted to an oil similar to crude petroleum (see William F. Taylor and Homer J. Hall, *Future Synthetic Fuels: A Scientific and Technical Applications Forecast*—1975, US Army Contract DAA05-73-C-0559, September 1975. See also *Increased Automobile Fuel Efficiency and Synthetic Fuels: Alternatives for Reducing Oil Imports*, NTIS order #PB83-126094, 1982). Direct liquefaction involves the use of hydrogen to chemically bond with molecules contained in coal, resulting in a more fluid material. One method by which hydrogen is transferred to coal is through the use of an intermediate "donor solvent" that contains excess hydrogen that is available to be transferred to hydrogen-poor molecules in coal. An example of a hydrogen donor solvent is tetrahydronaphthalene (tetralin), which contains four excess hydrogen atoms in each molecule. After transferring its excess hydrogen atoms to molecules contained in the coal, the tetralin is converted to naphthalene. Naphthalene can be re-converted to tetralin by exposing it to high temperature and high pressure in the presence of a metal catalyst. Examples of high pressure and high temperatures are 2500 psi and 425° C., respectively (reference: *Increased Automobile Fuel Efficiency and Synthetic Fuels: Alternatives for Reducing Oil Imports*, NTIS order #PB83-126094, 1982, p. 164. See also Baughman, Gary L., Synthetic Fuels Data Handbook. Second Edition, Denver, Colo.: Cameron Engineers, Inc. 1978).

The absorption of hydrogen by coal results in a more fluid material, especially at high temperature. By converting coal to a liquid in this manner, it is possible to remove insoluble solids, such as, but not limited to, fixed carbon and mineral matter, by either filtration or centrifugation, resulting in a nearly pure hydrocarbon liquid.

The process of dissolving coal in a solvent and reconstituting it without insoluble solids present is generally known as solvent extraction. It should be noted, however, that this is not a simple solution process. Rather, because of the large number of chemicals present in coal, there are a variety of chemical processes that can result in a phase change from solid to liquid. Specifically, it is thought that large molecular weight molecules contained in coal can be broken down into smaller molecular weight molecules by hydrogen-rich donor solvents. True chemical reactions are also thought to be likely to occur, as described above, such that hydrogen is physically transferred to certain molecules contained in coal. Thus, the solid-to-liquid phase change of coal in the presence of a liquid donor solvent likely consists not only of dissolution but also chemical digestion. For that reason it is more accurate to say that coal is "extracted" by the liquid, rather than simply "dissolved," although outwardly the process resembles dissolution. Thus, as used herein, the term "extraction" (or "solvent extraction") means the removal of material from coal (or other solids-containing mixture) by means of one or more solvents, wherein the removed (i.e., "extracted") material simply dissolves in the solvent(s) and/or reacts to form a compound that is soluble in the solvent(s).

Alternative solvent extraction techniques for producing synthetic pitch from coal have been described previously. For example, Zondlo et al (U.S. Pat. No. 5,955,375, which is incorporated herein by reference) describe a solvent extraction process for coal using an NMP-type solvent. These solvents are described, for example, in U.S. Pat. No. 4,272,356 (hereinafter, "Stiller et al."), which is also incorporated herein by way of reference. In the process described by Zondlo et al., the solvent is separated from the final product via evaporation or some other process. In typical solvent extraction processes for producing synthetic pitch from coal, the final product contains about 2% or less (by weight) of components derived from the solvent. In other words, at least 98% of the solvent is recovered and typically is recycled back to the extraction process. Because of the expense of the solvents typically used for producing synthetic pitch from coal, the process generally is not economical if more than a few percent of the solvent is left in the final product. In addition, the desired properties of the synthetic pitch may be adversely affected if too much solvent remains in the final product.

Blending is a well-known method to modify pitch properties. For example, Stansberry et al. describe how synthetic pitch may be blended with conventional coal tar pitch and other hydrocarbons in order to create modified pitches having certain desirable properties. Stansberry, P. G., J. W. Zondlo, and R. H. Wombles; Development of binder pitches from coal extract and coal-tar pitch blends; Light Metals, 581-585 (2001). However, the use of blended hydrocarbons as a solvent for extracting coal has not been previously described.

SUMMARY

One embodiment provides a method of producing a synthetic pitch from coal, comprising:

(a) heating an extraction mixture comprising solid hydrocarbons and at least one feedstock solvent for a period of time sufficient to extract one or more soluble portions of the solid hydrocarbons in the at least one feedstock solvent;

(b) removing undissolved solids from the extraction mixture; and (c) removing at least a portion of low-boiling point species from the extraction mixture, thereby producing a synthetic pitch, wherein between about 10% and about 90% by weight of the pitch comprises species provided by the at least one feedstock solvent.

In one embodiment, between about 10% and about 15% by weight of the pitch comprises species provided by the at least one feedstock solvent. A variety of solid hydrocarbons may be used in the process, particularly coal. At least a portion of the at least one feedstock solvent may also be hydrogenated prior to being heated with the solid hydrocarbons. Hydrogenation may be performed by heating at least a portion of the feedstock solvent to a temperature of between about 200° C. and about 500° C. in a hydrogen atmosphere with a hydrogen pressure of up to about 3000 psig, such that the feedstock solvent of the extraction mixture has between about 0.1% and about 10% absorbed hydrogen by weight.

A variety of feedstock solvents may be used, such as coal tar distillates, petroleum distillates, petroleum catalytic cracker products, distillates of gasification tars, products from the pyrolysis of recycled hydrocarbons, and aromatic oil products obtained from the distillation of shale oil and tar sands. By way of example, the feedstock solvent may comprise a hydrocarbon material having a softening temperature less than about 200° C., and contain at least 10% by weight of hydrocarbon species having a boiling point greater than about 350° C.

The method of the present invention may further include the step of air blowing the extraction mixture at a temperature of between about 70° C. and about 500° C. after the step of removing at least a portion of low-boiling point species. In addition, the extraction mixture may be agitated during heating, wherein the agitating step is performed by at least one of mechanical stirring and applying ultrasound.

DETAILED DESCRIPTION

Figure 1:
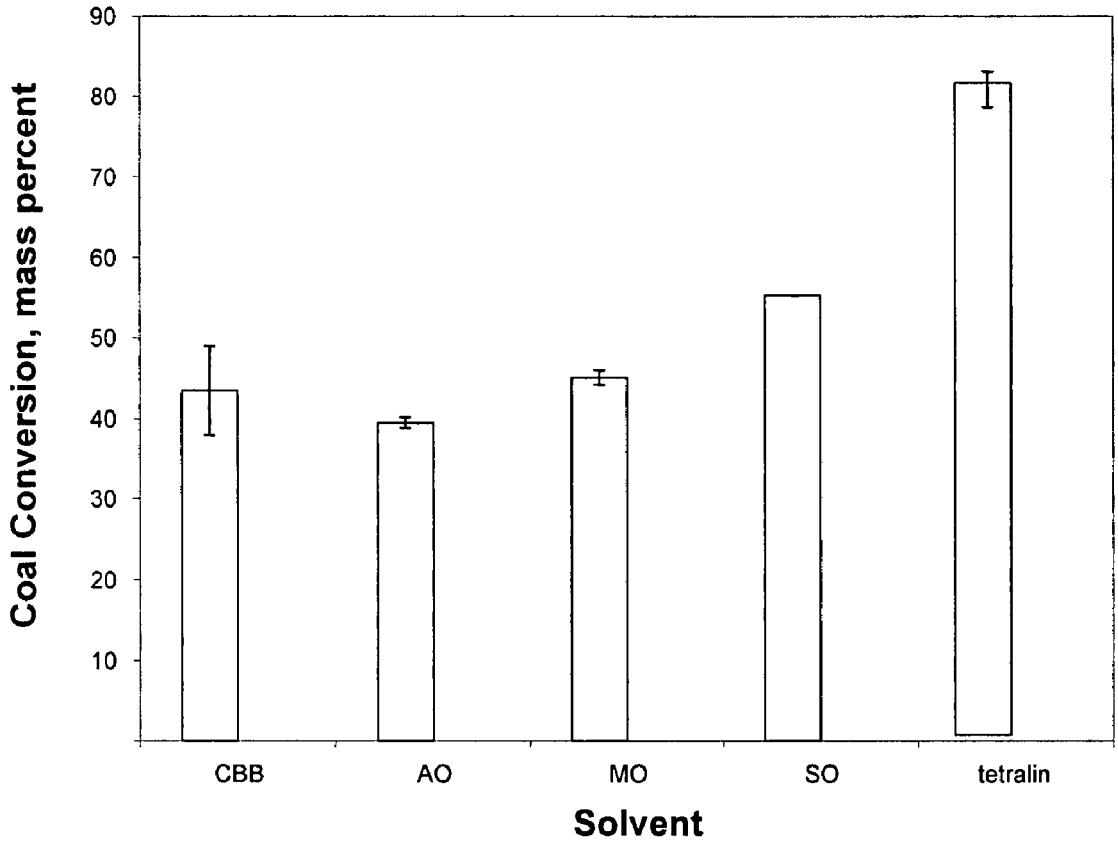
FIG. 1 is a chart depicting an example of coal conversion using various solvents in accordance with one embodiment.

In one embodiment, the present invention provides a process for producing synthetic pitch from a mixture of solid hydrocarbons, such as coal, using solvent extraction, wherein at least part of the solvent(s) used for extraction remains in the synthetic pitch product. At least a portion of the extraction solvent(s) may be hydrogenated, and hydrogenation may be performed prior to solvent extraction. A portion of the coal (or other mixture of solid hydrocarbons) is extracted using one or more feedstock solvents (the extraction solvents). Thereafter, undissolved solids may be removed (e.g., using centrifugation and/or filtration). In the case of coal, the result is a hydrocarbon liquid containing solvent and the extracted coal components, with less than about 1% mineral matter content. This hydrocarbon liquid may be further refined by processes such as distillation or air blowing. For example, light hydrocarbons and a portion of the feedstock solvent(s) may be removed and recycled for subsequent re-use in the process. Air blowing may be accomplished by exposing the hydrocarbon liquid to air, typically by bubbling or blowing air through the liquid. Air blowing cross-links certain molecules within the hydrocarbon liquid or to otherwise entrain or remove organic molecules in the vapor state.

The resulting synthetic pitch product thus may be comprised of not only material extracted from the coal (or other mixture of solid hydrocarbons), but also contains between about 10% and about 90% (by weight) of materials derived from the solvent(s) used for extraction. In another embodiment, the resulting synthetic pitch contains between about 10% and about 15% (by weight) of materials derived from the solvent(s) used for extraction. In addition, hydrogenation of the feedstock solvent(s) may improve the extractability of coal, thus allowing the use of lower cost solvents either in combination with solvents such as tetralin or in place of tetralin.

In some embodiments, two or more feedstock solvents may be blended together in order to tailor the properties of the synthetic pitch product. By way of example, for binder and impregnating pitch applications, the table (Table 1) below provides exemplary binder pitch properties that may be achieved with embodiments of the methods described herein:

TABLE 1

| | Binder Pitch | Impregnating Pitch |
|---|---|---|
| Softening Pt | 100-120° C. | 75-150° C. |
| Viscosity | <20 poise @ 160° C. | <50 cps @ 225° C. |
| Flash Pt | ≧200° C. | ≧270° C. |
| Coking Value (wt %) | 50-60 | 40-50 |

In order to further improve the solvent extraction (i.e., improve coal solubility) and tailor the properties of the synthetic pitch product, at least a portion of the feedstock solvent(s) may be hydrogenated externally prior to being mixed with the unhydrogenated portion of the feedstock solvent(s). While all of the feedstock solvent(s) may be hydrogenated, this is usually not necessary (and adds to processing costs). The hydrogenated solvent(s) or blend of hydrogenated solvents are found to be effective in incorporating coal to a liquid phase through a process that resembles simple dissolution. However, it is thought that molecules in coal may be incorporated into the liquid phase through one of three routes. First, coal molecules may be dissolved in the solvent. Second, the coal may be broken down into lower molecular weight species. These lower molecular weight species may be more readily dissolved or incorporated into the liquid phase solution. Third, hydrogen may be physically transferred from the solvent molecules to chemicals contained in the coal, modifying their solubility characteristics. Thus, in addition to simple dissolution, the presence of hydrogen may result in digestion and breakdown of polymeric coal molecules, thus resulting in smaller chemical species that can be incorporated into a liquid phase. In fact, Applicants have found that blends of solvents containing both hydrogenated and non-hydrogenated components can improve the yield to over 90%, particularly when the extraction is performed at an elevated temperature. Furthermore, one or more inorganic catalysts may be added in order to increase the yield of coal extraction.

Although not required, it is also contemplated that one or more additional solvents, such as, but not limited to, tetralin, decalin, tetrahydrofuran, or aprotic dipolar solvents, such as, but not limited to, n-methyl pyrrolidone ("NMP") may be blended with the feedstock solvent(s) in order to decrease the viscosity of the resultant solution and to enhance the solubility of coal in the solution. By reducing the viscosity of the solution, processing will be facilitated (particularly removal of the undissolved solids, such as, by use of centrifugation). When an additional solvent is employed, most of the additional solvent will be removed from the final pitch product and recycled back into the process.

Furthermore, in some embodiments, the synthetic pitch product may be distilled in order to remove low boiling point light volatile chemicals, and then air blown in order to crosslink hydrocarbon molecules without oxidation, resulting in a modification of the softening point and increased coke yield. Air blowing may also reduce the amount of low boiling point species that much be removed from the product. Air blowing parameters may even be controlled in order to tailor the properties of the synthetic pitch product.

Figure 4:
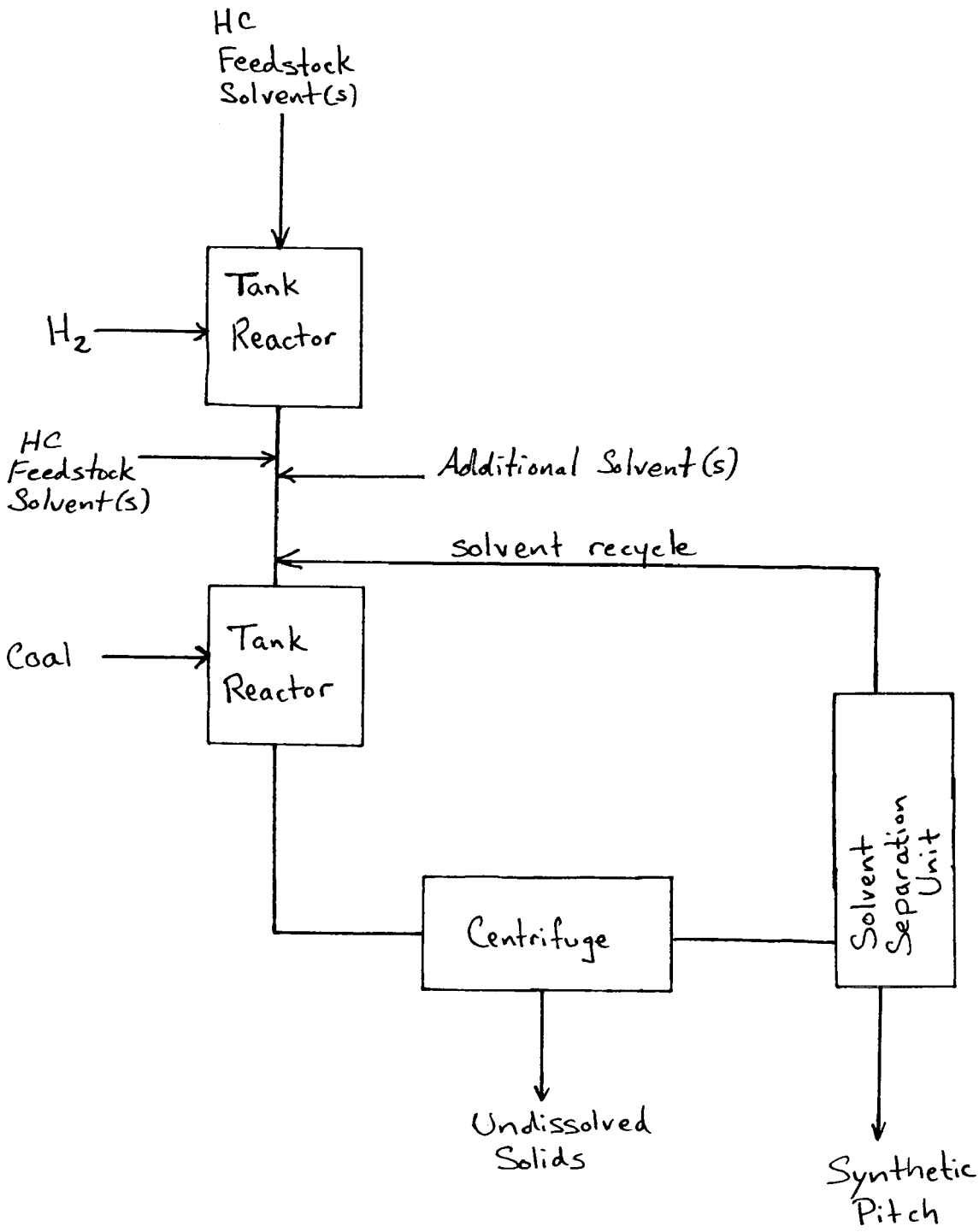
FIG. 4 is a block flow diagram of an example of a processing system that may be used to produce synthetic pitch in accordance with one embodiment.

FIG. 4 is a block flow diagram depicting an exemplary processing system that may be used to produce synthetic pitch in accordance with one or more embodiments. While FIG. 4 is merely exemplary, the following detailed description of methods of producing synthetic pitch according to one or more embodiments, at times, refer to FIG. 4 for purposes of clarity.

As shown in FIG. 4, all or a portion of the feedstock solvent(s) used for coal extraction may be fed to a high pressure heated tank reactor (or other suitable vessel) along with hydrogen gas in order to hydrogenate a portion of the feedstock solvent(s). Optionally, a catalyst, such as, but not limited to, iron, cobalt, nickel, molybdenum, tin, salts of the foregoing metals, or mixtures of any of the foregoing, may also be added to the reactor in order to enhance the absorption of hydrogen by the solvent. The feedstock solvent(s) may be hydrogenated such that the feedstock solvent mass may be increased by up to several percent due to absorption of hydrogen. Following hydrogenation of at least a portion of the feedstock solvent(s), the hydrogenated solvent(s) may be combined with one or more unhydrogenated feedstock solvents, and, optionally, one or more additional solvents (e.g., tetralin). The blended solvent thus produced may have about 0.1% to about 10% (by weight) absorbed hydrogen, or between about 0.2% to about 5% absorbed hydrogen. As also noted in FIG. 4, and as described further herein, solvent that has been removed from the pitch product may be blended with the feedstock solvent(s) prior to being added to a second tank reactor in which the extraction takes place. This solvent recycle stream may include not only solvent (feedstock and additional solvent) and solvent fractions removed from the pitch, but also other light hydrocarbons extracted from the coal. As used herein, "light hydrocarbons" refer to materials having a boiling point lower than about 200° C., making them difficult to incorporate into a pitch product intended to withstand devolatilization until over 350° C. Recycling of a portion of the solvent can permit dissolution of additional quantities of coal. Alternatively, the portion of solvent removed from the final pitch product may be considered a separate product (e.g., for use as an octane enhancer).

After hydrogenation, the feedstock solvent(s) and optional additional solvent(s) and recycled solvent(s) may be transferred to a second heated reactor and combined with coal (or other solids-containing material to be extracted). In one embodiment, the mass ratio of coal to total solvents may be about 1:2.5 or greater. The solvent(s) will extract the coal in the manner described previously. The second heated reactor may be operated at ambient pressure, since hydrogen gas is not necessary. While the feedstock solvent(s) and coal may be hydrogenated simultaneously in the extraction vessel, hydrogenating the feedstock solvent(s) in a separate reactor before extraction avoids the need to deal with solid particulates from the coal in a high pressure, high temperature reactor. It is also possible to avoid the hydrogenation step completely, however, in this case, the solubility of coal in the solvents is decreased.

In some embodiments, any of a variety of coals may be used as a feed material for making synthetic pitch. However, Applicants have found that bituminous, sub-bituminous, and lignite type coals may be suitable for the production of binder pitch. In one embodiment, the coal may be reduced in physical size to particles of less than about ¼" diameter. In fact, the coal may be in the form of a powder (e.g., particles less than about 20 mesh, or less than about 1 mm in diameter). The coal may be placed, for example, in a bin feeder or other container and fed by an auger or other solid feeding system into the second tank reactor (see FIG. 4).

As mentioned previously, a wide variety of hydrocarbon feedstock solvents may be used in some embodiments, particularly those which are produced in large quantities, such as oils distilled from coal tars or petroleum (i.e., coal tar distillates and petroleum distillates). The feedstock solvent(s) not only extracts the coal, but also contributes various hydrocarbon molecules that are incorporated into the synthetic pitch product of one or more embodiments of the present invention. In particular, hydrocarbon materials containing at least about 10% by weight of hydrocarbon species having a boiling point greater than about 350° C. and that have a softening temperature less than about 200° C. may be used. A high boiling point is desirable because hydrogenation is generally not very effective below about 350° C. The feedstock solvent(s) may also be a liquid at a temperature of about 200° C. and higher so that coal may be extracted into the liquid phase, while the insoluble material from coal can be separated from the liquid phase.

Exemplary feedstock solvents that may be employed in some embodiments include:

A. Distillates of Coal Tar.

Coal tar may be produced by condensing vapors from coal coking ovens and certain coal gasifiers. By convention, the distillates of coal tar are often broken into three major groups: light distillates, medium distillates, and heavy distillates. The light distillates typically are distilled below about 200° C. and contain compounds such as benzene, toluene, xylene, phenol and others. Middle distillates, obtained at roughly 200° C. to 300° C., are sometimes referred to as naphthalene oils, middle oils, creosote oils, wash oils, anthracene oils and heavy oils, for example. Middle distillates of coal tar often contain compounds such as: naphthalene; indene; biphenyl heterocyclic compounds such as quinoline, pyridine and/or phenol; various combinations of two aromatic rings and single alkyl groups such as acenaphthene, dibenzofurane and methyl fluorenes. The heavy distillates of coal tar are obtained from about 300° C. to 350° C., and include anthracene oil and/or heavy oil, which contain compounds having three or four aromatic ring structures such as anthracene, fluoranthene, pyrene, crysene and systems of hetero-atoms like carbazol.

B. Petroleum Derived Liquids.

Various liquids derived from petroleum, including, but not limited to, distillation products (i.e., petroleum distillates) as well as petroleum catalytic cracker products, may also be used as feedstock solvents. These include substances such as, but not limited to, naphthalene, decant oil slurry oil and other heavy aromatic oils capable of accepting and transferring hydrogen.

C. Distillates of gasifications tars, such as, but not limited to, those obtained as condensates from gasified coal, gasified biomass, gasified polymer waste or other gasified carbonaceous material. In addition, products synthesized from gasified coal, gasified biomass, gasified polymer waste or other gasified carbonaceous material may be used as feedstock solvent(s). These products include, for example, products made by Fischer-Tropsch synthesis using the aforementioned gasified materials.

D. Products obtained from the pyrolysis of recycled hydrocarbons, such as, but not limited to, used motor oil, rubbers (e.g., recycled tire rubber), and thermoplastics (e.g., polypropylene, polyester or polyvinyl chloride), thermosets, grease, and chemical wastes.

E. Aromatic Oil Products Obtained from the Distillation Shale Oil Or Tar Sands.

It has been found that coal solubility and coke yield of the pitch product may be improved if a portion of the feedstock solvent(s) is hydrogenated, such as when hydrogenation is performed prior to blending with other solvents and before the solvent blend is combined with the coal. Hydrogenation may be accomplished by a variety of techniques, such as by exposing the feedstock solvent to hydrogen gas at an elevated temperature and $H_2$ pressure, optionally in the presence of a metallic catalyst. For most feedstock solvents, hydrogenation can be accomplished at a temperature of between about 200 and about 500° C. (e.g., between about 350 and about 500° C.), and an $H_2$ pressure of up to about 3000 psig (e.g., greater than about 400 psig). In this manner, the hydrogen content of the hydrogenated solvent will be increased by at least about 0.1% (by weight), thus effecting a partial direct liquefaction of the hydrocarbons in the feedstock solvent and increasing the aromatic content. Typically between about 25% and about 100% of the feedstock solvent may be hydrogenated.

One or more inorganic catalysts may also be added to the tank reactor to facilitate hydrogenation of the feedstock solvent, thus resulting in an increased amount of hydrogen absorption. Suitable catalysts include, but are not limited to, various pure metals or salts of iron, cobalt, nickel, molybdenum or tin, or mixtures thereof. Suitable catalysts can include a mixture of 3% nickel, 13% molybdenum, and 84% aluminum. Other combinations of nickel and molybdenum on various supports may also be used as a catalyst. The catalyst(s) is not consumed during the process, so, for example, a kilogram of catalyst can be used to process many tons of solvent. These catalysts, when added to the hydrogen reactor (the first tank reactor in FIG. 4) may increase the amount of hydrogen that can be absorbed by the solvent and ultimately transferred to the coal. Also, the use of one or more catalysts may lower the temperature needed for extraction.

In the extraction vessel (e.g., the second tank reactor in FIG. 4), the crushed coal may be mixed with a solvent or solvent blend (e.g., one or more feedstock solvents and one or more additional solvents) at a temperature greater than about 100° C. such that the solvent(s) can extract the coal. In one embodiment, the extraction mixture may be heated until the coal begins to decompose thermally, typically between about 350° C. and about 425° C. In order to improve extraction, the extraction mixture may be agitated, such as by mechanical stirring and/or by use of ultrasound. The result is a slurry of undissolved solids in a hydrocarbon liquid solution comprising the solvent(s) and dissolved (i.e., extracted) coal. In one embodiment, at least about 85% of the coal is extracted into the solvent(s). The solvent extraction need not be performed under a hydrogen atmosphere, however, a hydrogen atmosphere may optionally be used in order to enhance the absorption of hydrogen.

After completion of the extraction process, the undissolved solids in the slurry may be removed, such as by filtration or centrifugation, thereby leaving a liquid phase solution containing the extracted coal components and the solvent(s). Following extraction, additional solvent may optionally be added in order to reduce the viscosity of the slurry, thus enhancing the effectiveness of centrifugation or filtration. By way of example, the slurry may be pumped (e.g., via a sludge pump) from the extraction vessel to a centrifuge. The centrifuge can separate liquid phase material from undissolved solids. The undissolved solids may simply be deposited into a bin or other storage device. These undissolved solids will typically include solid mineral matter, such as inertinite and charcoal. The undissolved solids may be added to asphalt as a filler, used as combustion fuel, or gasified to produce a process gas and hydrogen.

After removal of undissolved solids, the remaining extraction mixture may comprise hydrocarbon liquids and soluble, coal-derived species. This solution may then flow to a solvent separation unit, such as any of a variety of fractional distillation units, such as, but not limited to, a wiped film evaporator or distillation column. In the solvent separation unit, the extraction mixture may be distilled in order to remove low-boiling point species, including excess solvent (particularly any additional solvents employed). A purified, synthetic pitch may be collected (e.g., in a collection drum). This pitch may have enhanced aromaticity, increased softening point, increased cross-linking reactivity, and increased carbon coking value compared to the pitch properties prior to distillation. Upon cooling to a temperature below about 110° C., the resultant synthetic pitch generally solidifies.

The pitch thus produced can have properties making it suitable for use as a binder pitch. Binder pitch may be used either for carbon anodes for Hall Heroult cells for aluminum smelting, for graphite electrodes for electric arc furnaces, or for other purposes. The pitch produced in accordance with the embodiments may also be used for other purposes, such as, but not limited to, an impregnation pitch used to produce carbon composites, as well as fiber spinning pitch used to produce carbon fibers. The low-boiling point species removed in the solvent separation unit may be optionally recycled back to be blended with the solvents used for subsequent coal extraction, with or without an additional hydrogenation cycle.

After distillation to separate lighter fractions as described above, air blowing can optionally be used to crosslink heavier molecules in the pitch, thus increasing the average molecular weight of the pitch product and creating a potential precursor for anode-grade coke (i.e., slightly anisotropic) or needle coke (more highly anisotropic). If air blowing is performed prior to removing lighter fractions from the product, the resultant pitch may produce a more isotropic coke that may not be suitable for anode grade coke or needle coke. Air blowing of the extraction mixture may be performed at a temperature of between about 250° C. and about 450° C. This can be accomplished, for example, by bubbling air through a tube inserted in a tank containing the pitch. Alternatively, a sparger can be used to increase mixing between air and pitch.

The following examples are meant to illustrate exemplary embodiments of the present invention, and are not intended to limit the scope of the embodiments as described herein and as defined in the claims:

1. Use of Solvent Blends to Enhance Coal Extraction

Experiments were carried out with different solvents to determine whether hydrogenation improved the apparent solubility of coal in each solvent. Solvents trialed included carbon black base oil ("CBB", a coal tar distillate obtained from Koppers), anthracene oil ("AO", a coal tar distillate obtained from Reilly Industries), Maraflex® Oil ("MO", a mixture of petroleum distillates obtained from Marathon-Ashland), residual catalytic cracker slurry oil ("SO", obtained from Marathon-Ashland), and tetrahydronaphthalene ("tetralin").

FIG. 1 depicts the coal conversion, in mass percent, obtained using bituminous coal and the above-mentioned solvents. The crushed coal was placed into a sealed container along with the identified solvent at 400° C. for approximately one hour. Pressure within the sealed container was controlled by the vapor pressure of the solvent used. The coal conversion reported in the figure below is simply the fraction of coal mass that was converted from a solid to a liquid phase. These results indicate that tetralin, a know hydrogen donor solvent, is better than the other solvents in terms of coal conversion.

In order to determine whether hydrogenation can enhance the ability to extract coal in the liquid phase, three different hydrogenation conditions were established, as shown in Table 2.

TABLE 2

Solvent Hydrogenation Results

| Run Description | Wt % H2 absorbed | Hydrogenation Reactor T, ° C. | Initial cold H2 Pressure (psig) |
|---|---|---|---|
| CBB Hydrogenation Level 1 | 0.10 | 275 | 500 |
| CBB Hydrogenation Level 2 | 0.14 | 350 | 500 |
| CBB Hydrogenation Level 3 | 0.24 | 375 | 750 |
| Slurry Oil Hydrogenation Level 3 | 0.24 | 375 | 750 |
| Maraflex Oil Hydrogenation Level 3 | 0.24 | 375 | 750 |

Figure 2:
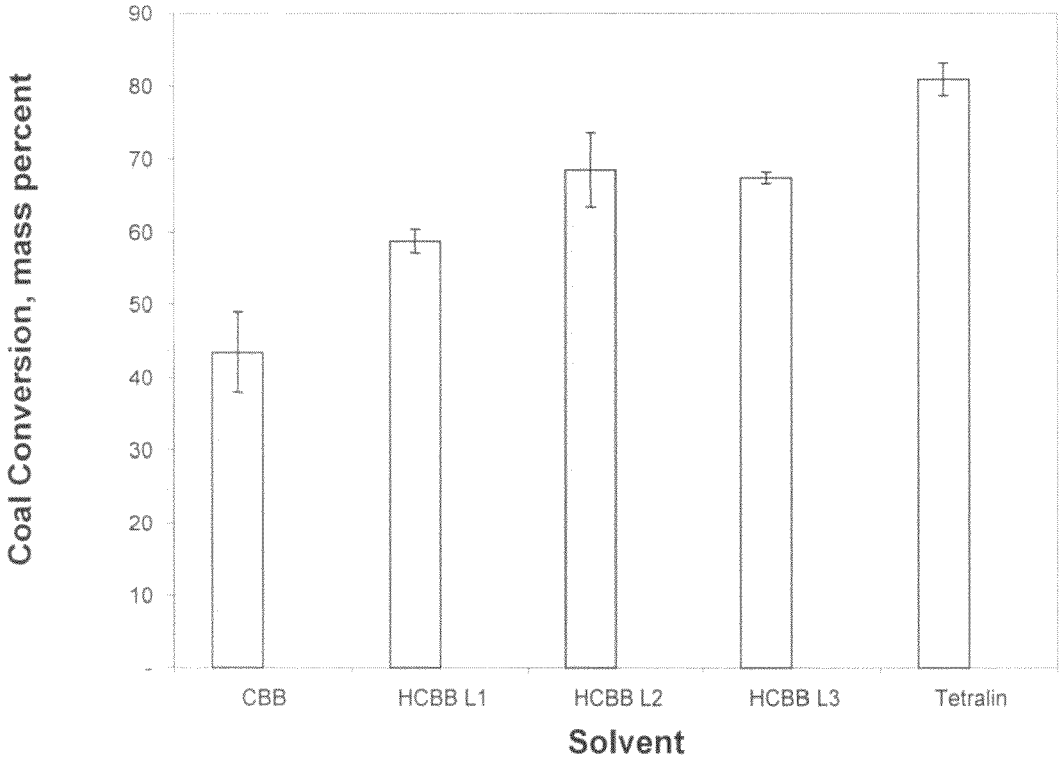
FIG. 2 is a chart depicting an example of the benefits of hydrogenation of the feedstock solvent on coal conversion, in accordance with one embodiment.
Figure 3:
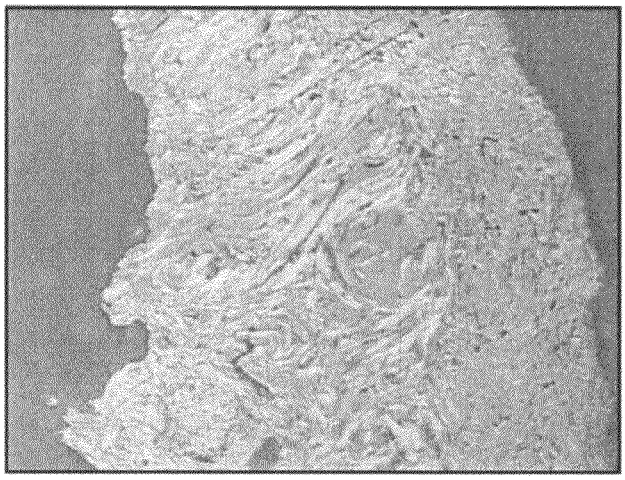
FIG. 3 is a photomicrograph of an example of a synthetic pitch produced in accordance with one embodiment.

Coal extraction using these hydrogenated solvents was performed in the same manner as described previously. As shown in FIG. 2, coal conversion using hydrogenated solvents from coal tar distillates (e.g., carbon black base oil) is significantly improved as compared to the use of non-hydrogenated forms of those same solvents. In fact, the performance was similar to that of tetralin.

Subsequently, experiments with bituminous coal and CBB L3 produced coal conversion of 90% at 425° C. This shows that hydrogenation of hydrocarbon materials can produce an effective alternative to tetralin, a much more expensive solvent that generally cannot be economically incorporated into the pitch product.

2. Distilling Coal Extract to Form Pitch of Desired Softening Point & Coke Yield After removing the insoluble solids from the liquid phase extract (e.g., by centrifugation), it generally is necessary to distill the liquid phase extract so that lower boiling point volatile molecules are removed, and the softening point of the extract is raised. By controlling the distillation temperature, the characteristics of the extract can likewise be controlled, especially its softening point. Generally, removal of lower boiling point liquids results in elevating the softening point of the mixture.

Optionally, air blowing can be used to complement distillation. Air blowing involves heating the extract and exposing the extract to air, usually with the aid of a sparger that blows air in from the bottom of the extract container. The effect of air blowing is to encourage cross-linking of molecules in the extract. If air blowing is accomplished without removing lower molecular weight, lower boiling point volatile molecular species, the result is an extract with a more isotropic character. Thus, if such an extract is further heated in an oxygen-depleted environment, the resultant coke is very isotropic. Conversely, by removing low molecular weight volatile species via distillation at a temperature in excess of 100° C., followed by air-blowing at a temperature in excess of 200° C., a more anisotropic coke precursor can be formed. That is, when the air-blown extract is further heated in an oxygen-depleted environment to create coke, a more anisotropic coke is formed.

FIG. 1 illustrates a 160× polarized light photomicrograph of one embodiment of a synthetic pitch distilled and then treated by air blowing. The resultant material is anisotropic as evidenced by the contoured regions visible under polarized light.

The specific illustrations and embodiments described herein are exemplary only in nature and are not intended to be limiting of the invention defined by the claims. Further embodiments and examples will be apparent to one of ordinary skill in the art in view of this specification and are within the scope of the claimed invention.

What we claim is:

1. A method of producing a synthetic binder pitch from coal, comprising:

(a) hydrogenating feedstock solvent in a first tank reactor, wherein the feedstock solvent comprises at least one additional solvent selected from the group consisting of: tetralin, decalin, tetrahydrofuran, and aprotic dipolar solvents such as n-methyl pyrrolidone;

(b) producing a mixture of hydrogenated and unhydrogenated feedstock solvents by combining said hydrogenated feedstock solvent exiting said first tank reactor with unhydrogenated feedstock solvent;

(c) combining said mixture of hydrogenated and unhydrogenated feedstock solvents with coal to produce an extraction mixture in a second tank reactor downstream of said first reactor;

(d) heating said extraction mixture for a period of time sufficient to extract one or more soluble portions of said coal into said mixture of hydrogenated and unhydrogenated feedstock solvents;

(e) removing undissolved solids from said extraction mixture;

(f) removing light hydrocarbons from said extraction mixture, thereby producing the synthetic binder pitch, wherein the synthetic binder pitch comprises a softening temperature between 100 and 120° C. and a coking value between 50 and 60% by weight;

(g) recycling said light hydrocarbons and at least a portion of said mixture of hydrogenated and unhydrogenated solvents to said second tank reactor, wherein said at least one feedstock solvent comprises a hydrocarbon material having a softening temperature less than about 200° C., and contains at least 10% by weight of hydrocarbon species having a boiling point greater than about 350° C.

2. A method of producing a synthetic binder pitch from coal, comprising:

(a) hydrogenating feedstock solvent in a first tank reactor, wherein the feedstock solvent comprises at least one additional solvent selected from the group consisting of: tetralin, decalin, tetrahydrofuran, and aprotic dipolar solvents such as n-methyl pyrrolidone;

(b) producing a mixture of hydrogenated and unhydrogenated feedstock solvents by combining said hydrogenated feedstock solvent exiting said first tank reactor with unhydrogenated feedstock solvent;

(c) combining said mixture of hydrogenated and unhydrogenated feedstock solvents with coal to produce an extraction mixture in a second tank reactor downstream of said first reactor;

(d) heating said extraction mixture for a period of time sufficient to extract one or more soluble portions of said coal into said mixture of hydrogenated and unhydrogenated feedstock solvents;

(e) removing undissolved solids from said extraction mixture;

(f) removing light hydrocarbons from said extraction mixture, thereby producing the synthetic binder pitch, wherein the synthetic binder pitch comprises a softening temperature between 100 and 120° C. and a coking value between 50 and 60% by weight;

(g) recycling said light hydrocarbons and at least a portion of said mixture of hydrogenated and unhydrogenated solvents to said second tank reactor, wherein at least 10% of said feedstock solvent comprises products synthesized from gasified coal, gasified biomass, gasified polymer waste, or other gasified carbonaceous material.

3. A method of producing a synthetic binder pitch from coal, comprising:

(a) hydrogenating feedstock solvent in a first tank reactor, wherein the feedstock solvent comprises at least one additional solvent selected from the group consisting of: tetralin, decalin, tetrahydrofuran, and aprotic dipolar solvents such as n-methyl pyrrolidone;

(b) producing a mixture of hydrogenated and unhydrogenated feedstock solvents by combining said hydrogenated feedstock solvent exiting said first tank reactor with unhydrogenated feedstock solvent;

(c) combining said mixture of hydrogenated and unhydrogenated feedstock solvents with coal to produce an extraction mixture in a second tank reactor downstream of said first reactor;

(d) heating said extraction mixture for a period of time sufficient to extract one or more soluble portions of said coal into said mixture of hydrogenated and unhydrogenated feedstock solvents;

(e) removing undissolved solids from said extraction mixture;

(f) removing light hydrocarbons from said extraction mixture, thereby producing the synthetic binder pitch, wherein the synthetic binder pitch comprises a softening temperature between 100 and 120° C. and a coking value between 50 and 60% by weight;

(g) recycling said light hydrocarbons and at least a portion of said mixture of hydrogenated and unhydrogenated solvents to said second tank reactor, wherein at least 10% of said feedstock solvent comprises products obtained from the pyrolysis of recycled hydrocarbon sources, such as recycled tire rubber, thermoplastics, thermosets, motor oil, grease, and chemical waste.

4. A method of producing a synthetic binder pitch from coal, comprising:

(a) hydrogenating feedstock solvent in a first tank reactor, wherein the feedstock solvent comprises at least one additional solvent selected from the group consisting of: tetralin, decalin, tetrahydrofuran, and aprotic dipolar solvents such as n-methyl pyrrolidone;

(b) producing a mixture of hydrogenated and unhydrogenated feedstock solvents by combining said hydrogenated feedstock solvent exiting said first tank reactor with unhydrogenated feedstock solvent;

(c) combining said mixture of hydrogenated and unhydrogenated feedstock solvents with coal to produce an extraction mixture in a second tank reactor downstream of said first reactor;

(d) heating said extraction mixture for a period of time sufficient to extract one or more soluble portions of said coal into said mixture of hydrogenated and unhydrogenated feedstock solvents;

(e) removing undissolved solids from said extraction mixture;

(f) removing light hydrocarbons from said extraction mixture, thereby producing the synthetic binder pitch, wherein the synthetic binder pitch comprises a softening temperature between 100 and 120° C. and a coking value between 50 and 60% by weight;

(g) recycling said light hydrocarbons and at least a portion of said mixture of hydrogenated and unhydrogenated solvents to said second tank reactor, wherein at least 10% of said feedstock solvent comprises aromatic oil products obtained from the distillation of shale oil or tar sands.

* * * * *

UNITED STATES PATENT AND TRADEMARK OFFICE

CERTIFICATE OF CORRECTION

PATENT NO. : 8,226,816 B2
APPLICATION NO. : 11/805737
DATED : July 24, 2012
INVENTOR(S) : Elliot B. Kennel et al.

It is certified that error appears in the above-identified patent and that said Letters Patent is hereby corrected as shown below:

ON THE TITLE PAGE:

Item (56) under Other Publications, Line 1, delete "Variaion" and insert -- Variation --

Item (56) under Other Publications, Line 2, delete "Composiiton" and insert -- Composition --

Signed and Sealed this
Twentieth Day of November, 2012

David J. Kappos

David J. Kappos
*Director of the United States Patent and Trademark Office*